US005222118A

United States Patent [19]

Gerth

[11] Patent Number: 5,222,118

[45] Date of Patent: Jun. 22, 1993

[54] LIQUID-FILLED X-RAY RADIATOR HAVING A DEGASIFIER FOR THE LIQUID

[75] Inventor: Heinz Gerth, Nuremberg, Fed. Rep. of Germany

[73] Assignee: Siemens Aktiengesellschaft, Munich, Fed. Rep. of Germany

[21] Appl. No.: 821,825

[22] Filed: Jan. 17, 1992

[30] Foreign Application Priority Data

Jan. 22, 1991 [DE] Fed. Rep. of Germany ..... 4101777

[51] Int. Cl.[5] ..... H01J 35/10

[52] U.S. Cl. ..... 378/200; 378/199; 378/202

[58] Field of Search ..... 378/193, 141, 199, 130, 378/200, 201, 202

[56] References Cited

U.S. PATENT DOCUMENTS 5,086,449 2/1992 Furbee et al. ..... 378/200

FOREIGN PATENT DOCUMENTS 62-274599 11/1987 Japan ..... 378/200

*Primary Examiner*—David P. Porta

*Attorney, Agent, or Firm*—Hill, Steadman & Simpson

[57] ABSTRACT

An x-ray radiator has a protective housing filled with liquid in which an x-ray tube is contained. Due to the interaction of the x-rays passing through the liquid from the x-ray tube out of the housing, gas is created in solution in the liquid. A degasifier is therefore provided within the protective housing, which includes a gas volume, a space accepting the liquid to be degasified, a liquid-impermeable wall separating the space from the gas volume, and which generates, in the space which accepts the liquid to be degasified, a partial gas pressure which is lower than the partial gas pressure of the gas to be eliminated.

12 Claims, 4 Drawing Sheets

LIQUID-FILLED X-RAY RADIATOR HAVING A DEGASIFIER FOR THE LIQUID

BACKGROUND OF THE INVENTION

1. Field of the Invention

The present invention is directed to an x-ray radiator of the type having a protective housing filled with a liquid in which an x-ray tube is contained.

2. Description of the Prior Art

An x-ray radiator is disclosed in European Application 0 248 976, corresponding to U.S. Pat. No. 4,768,212, having an exterior housing filled with an electrically insulating liquid, such as insulating oil, in which an x-ray tube is disposed. The housing has a radiation exit window, and as the x-rays propagate from the x-ray tube through the insulating oil to the exit window, the interaction of the x-rays with the insulating oil causes the insulating oil to decompose. Hydrogen is released as a result of this decomposition, which initially enters into solution in the insulating oil, however after saturation is reached, gas bubbles will arise. The occurrence of gas bubbles is disadvantageous for at least two reasons. The presence of gas bubbles in the path of the useful x-ray beam causes a degradation in the obtainable image quality when the x-ray radiator is used for imaging purposes. Secondly, the insulating effect of the oil is diminished due to the presence of gas bubbles therein, so that the risk of voltage arching exists.

SUMMARY OF THE INVENTION

It is an object of the present invention to provide an x-ray radiator of the type having a liquid-filled protective housing with an x-ray tube contained therein wherein the disadvantageous consequences of decomposition of the liquid due to the interaction of x-rays therewith are avoided.

It is a further object of the present invention to provide such an x-ray radiator wherein such disadvantageous consequences are avoided by minimizing the risk of the formation of gas bubbles in the liquid.

The above objects are achieved in accordance with the principles of the present invention in an x-ray radiator constructed in accordance with the principles of the present invention having a degasifier for the liquid contained in the housing. The degasifier is capable of removing gases dissolved in the liquid without the formation of disturbing gas bubbles. As a consequence of the degasifier in the x-ray radiator, no gas bubbles can arise in the liquid, and thus the disadvantageous effects of such bubbles on the image quality and on the insulating effect of the liquid are avoided.

In a preferred embodiment of the invention the degasifier includes a gas volume, a space accepting the liquid to be degasified, a liquid-impermeable wall separating this space from the gas volume, and means for producing a partial gas pressure in the gas volume, this partial pressure produced in the gas volume being lower than the partial gas pressure that the gas to be eliminated from the liquid has in the space which accepts the liquid to be degasified. The molecules of the gas to be eliminated from that volume of the liquid situated in the space then diffuse through the wall into the gas volume, so that the liquid is gradually degasified. This means that the wall must have an adequate gas diffusion capability for the gas to be eliminated from the liquid. The number of gas molecules diffusing through the wall per time unit will be approximately proportional to the product of the difference between the gas pressures in the space and in the gas volume, and the size of the effective wall area. The described degasification effect will occur whether the liquid situated in the space is stationary or flowing, therefore in an advantageous embodiment of the invention the liquid is made to continuously flow through the space in which the degasification takes place. It is thus possible to continuously proceed with the degasification process during operation of the x-ray tube. If, in a known manner, the liquid is conducted through a cooling means for eliminating the heat dissipated into the liquid during the operation of the x-ray tube, the flow rate of the liquid can be selected in accordance with the cooling requirements, without having any influence whatsoever on the degasification effect. If a plurality of gases arise due to the decomposition of the liquid contained in the housing, in a further embodiment of the invention the means for generating a partial gas pressure can generate a pressure in the gas volume which is lower than the partial gas pressure of a particular gas to be eliminated from the liquid that is present in the space accepting the liquid to be degasified.

In a particularly simple version of the invention, the means for generating a partial gas pressure can be a means for evacuating the gas volume, for example a vacuum pump.

Preferably the wall separating the gas volume from the space accepting the liquid to be degasified consists of polytetrafluorethylene (Teflon ®). This material has sufficient strength while also having extremely good gas diffusion capability, particularly for hydrogen which arises upon the decomposition of insulating oil, so that a good degasification effect is achieved.

In a further embodiment of the invention, the liquid to be degasified and the gas volume may be contained in a double-walled hose or tube, having an exterior wall and an interior wall, with the wall which separates the gas volume from the space for the liquid to be degasified being this interior wall. This structure is of particular advantage in x-ray radiators wherein the liquid contained in the protective housing is conducted through a cooling means, because an effective device for degasification of the liquid can be achieved solely by replacing the hoses or pipelines leading to the cooling means by a suitable double-walled hose or pipe, and by connecting the pipe or hose to a vacuum pump. The degasifier can thereby be easily combined with the x-ray radiator to form a single structural unit.

DESCRIPTION OF THE PREFERRED EMBODIMENTS

Figure 1:
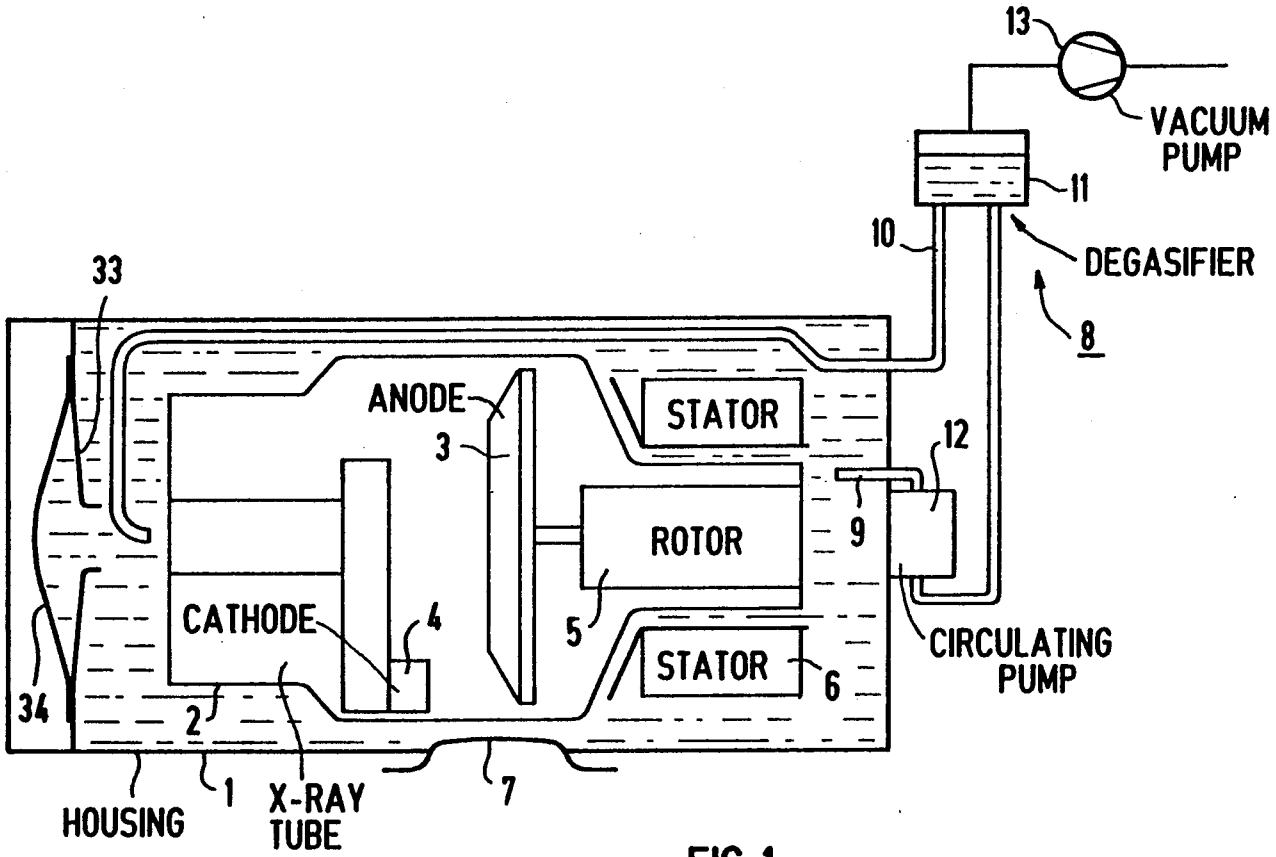
FIG. 1 is a side schematic view of an x-ray radiator constructed in accordance with the principles of the present invention in a first embodiment.

A first embodiment of an x-ray radiator constructed in accordance with the principles of the present invention is shown in FIG. 1, which includes a protective housing 1 filled with electrically insulating liquid, for example insulating oil, and containing an x-ray tube 2. The x-ray tube 2 is a rotating anode x-ray tube, having an anode dish 3, a cathode 4 and a motor for driving the rotating anode. The motor is formed by a rotor 5 and a stator 6, the stator 6 being disposed outside of the glass envelope of the x-ray tube 2. The protective housing 1 has a beam exit window 7 for permitting x-rays to emerge from the housing 1 emanating from the anode dish 3.

A degasifier, generally referenced 8, is provided for the insulating oil, which includes a container 11 connected to the protective housing 1 by two lines 9 and 10, and a circulating pump 12 for the insulating oil. The insulating oil is circulated through the container 11 in a closed circulation path. The circulating pump 12 is attached to an end face of the protective housing 1 adjacent to the stator 6. The lines 9 and 10 are conducted through the wall of the protective housing 1 in liquid-tight fashion. The line 9 terminates inside the protective housing 1 in the region of the stator 6, and the line 10 terminates in the region of the cathode-side end of the x-ray tube 2. As a result of the respective locations of these line terminations, a flow pattern for the insulating oil is created inside the protective housing 1 which assures that all of the insulating oil contained in the protective housing 1 is conducted through the container 11 of the degasifier 8 by the circulating pump 12.

In addition to the aforementioned components, the degasifier 8 includes a vacuum pump 13, having an intake (suction) side connected to the container 11. The quantity of insulating oil is selected such that, as schematically indicated, a liquid-free space which is charged with under-pressure by the vacuum pump 13 is present in the container 11 above the liquid level of the insulating oil. Degasification of the insulating oil occurs in this manner, so that the decomposition of the insulating oil which occurs due to the interaction of x-rays proceeding through the insulating oil cannot result in the formation of gas bubbles, in the oil, particularly hydrogen bubbles. The decomposition of the insulating oil which takes place thus does not have disadvantageous consequences on the image quality and on the insulating effect of the insulating oil.

The degasifier 8 and the x-ray radiator can only form a common structural unit when in the embodiment of FIG. 1 if the x-ray radiator experiences such slight positional changes during operation that it is possible for the vacuum pump 13 to draw insulating oil from the container 11. If the x-ray radiator is expected to experience larger changes in position, the container 11 must be stationarily arranged and connected to the x-ray radiator by flexible lines.

Figure 2:
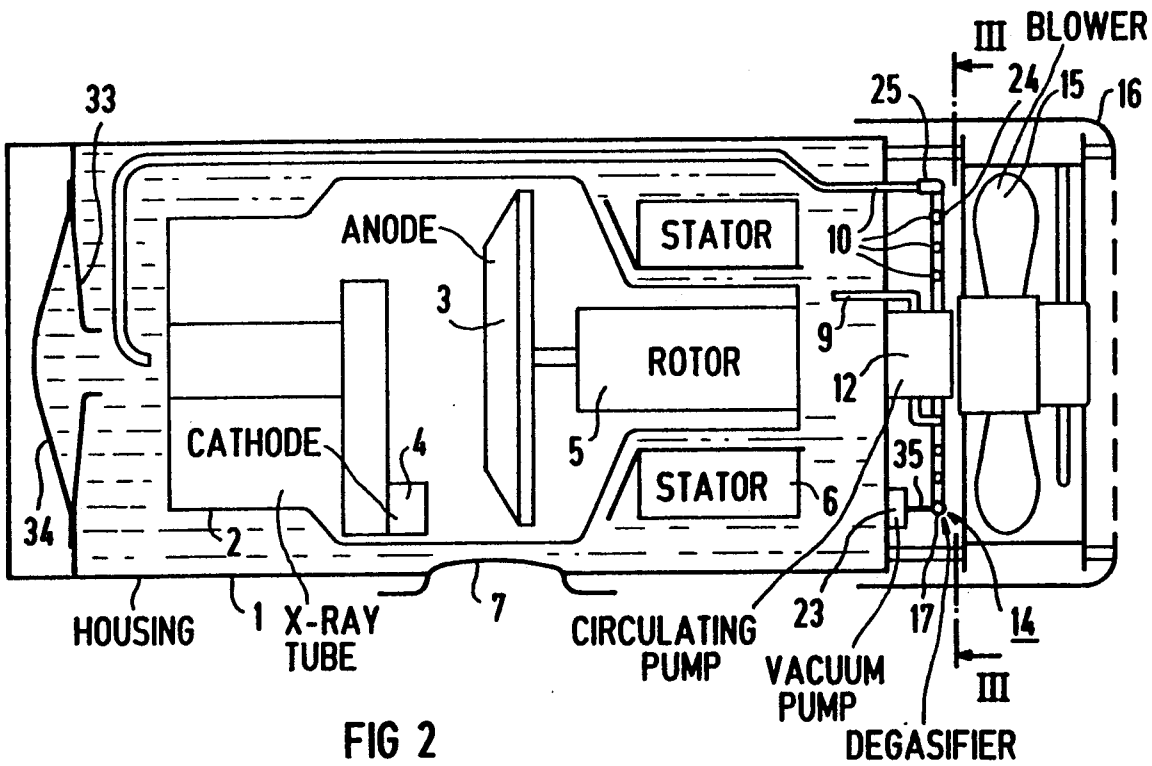
FIG. 2 is a side schematic view of an x-ray radiator constructed in accordance with the principles of the present invention in a second embodiment.
Figure 3:
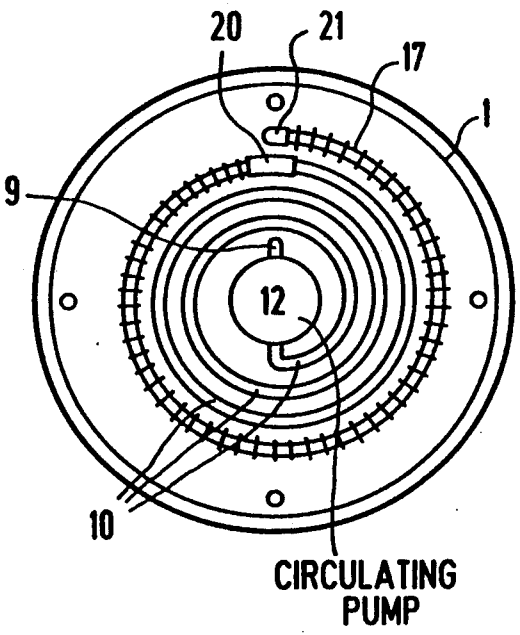
FIG. 3 is a sectional view of the x-ray radiator of FIG. 2, taken along line III—III.

The components for operating the x-ray radiator shown in FIG. 2 coincide with those in the embodiment of FIG. 1 and are therefore provided with the same reference numerals. In the embodiment of FIG. 2, however, the x-ray radiator is provided with a degasifier 14 different from the embodiment of FIG. 1, the degasifier 14 being operable independently of position. Additionally, the x-ray radiator in the embodiment of FIG. 2 is provided with a circulating cooling means for the insulating oil, as is known from the aforementioned U.S. Pat. No. 4,768,212. This cooling means eliminates the dissipated heat arising during operation of the x-ray tube 2, which is transmitted to the insulating oil. For this purpose, a tube 10 is wound helically into a plurality of turns, as shown in FIG. 3, and is disposed in front of the end face of the protective housing 1 at which the circulating pump 12 is disposed, so that the spiral turns of the line 10 are situated in the air stream generated by a blower 15. The turns of the line 10 as well as the blower 15 are disposed under a hood 16, having a perforated end face.

Figure 4:
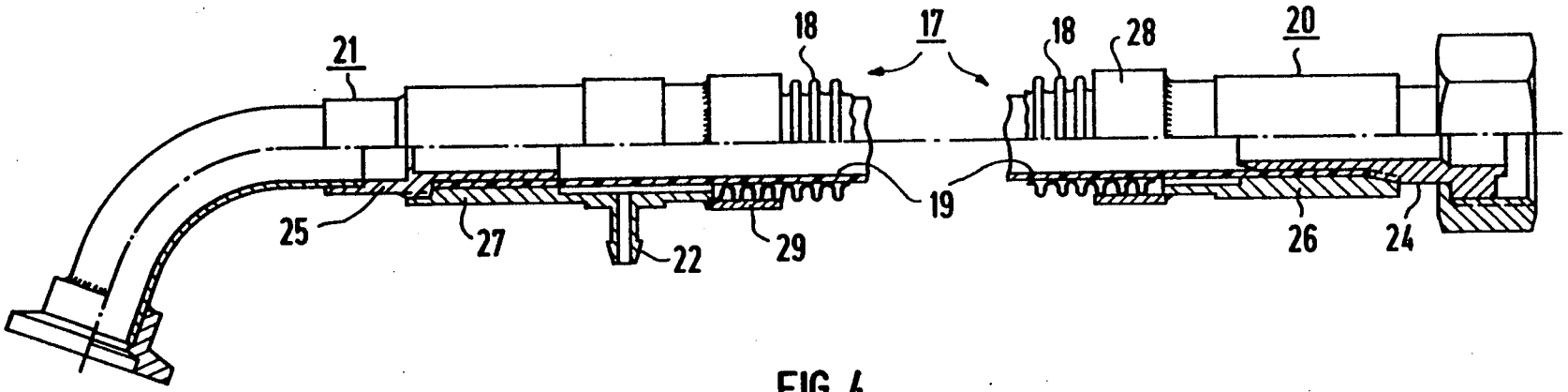
FIG. 4 is a view of portion of a double-walled hose for use in the degasifier in the x-ray radiator in the embodiment of FIG. 2.

The degasifier 14 includes a double-walled hose 17, forming a section of the line 10, at its outermost spiral turn. The double-walled hose 17 is shown straight in FIG. 4 for simplicity, and has an exterior wall in the form of a metallic accordion bellows 18, and an interior wall in the form of a polytetrafluorethylene (Teflon ®) hose 19. The bellows 18 and the hose 19 are connected vacuum-tight with connector parts 20 and 21 so that the bellows 18 and the hose 19 limit a gas volume therebetween which can be charged with under-pressure, or evacuated, with a vacuum pump 23 connected via a line 35 to a port 22 provided at the connector 21.

The insulating oil to be degasified is continuously circulated by the circulating pump 12 so as to flow through the interior of the hose 19. The gas volume limited between the bellows 18 and the hose 19 is evacuated by the vacuum pump 23 to such an extent that the pressure which is present in this gas volume is below the partial gas pressure in the inside of the hose 19 for that gas which is to be removed from the insulating oil which has the lowest partial gas pressure. Because polytetrafluorethylene is liquid-tight, but has a high gas diffusion capability, all of the gases which are to be removed from the insulating oil contained in the inside of the hose 19, primarily the hydrogen which arises upon decomposition of the insulating oil, gradually diffuse through the wall of the hose 19 into the gas volume limited by the bellows 18 and by the hose 19, from where the diffused gases can be removed by the vacuum pump 23. Because the insulating oil is continuously circulated with the circulating pump 12 and flows through the degasification 14, the insulating oil is constantly degasified, so that gas bubbles, particularly hydrogen bubbles, cannot arise.

An important advantage of the degasifier 14 is that it has an extremely simple structure, because no components which are susceptible to wear or malfunction, such as valves and the like, are required, nor is any type of control system required. The metallic accordion bellows 18, moreover, functions as a protective cladding for the polytetrafluorethylene hose 19. Because the vacuum pump 23 is also secured to one end face of the protective housing 1, the degasifier 14, the circulation cooling means and the x-ray radiator can be combined to form a single structural unit which can be operated independently of position.

The connection of the bellows 18 and of the hose 19 to the connectors 20 and 21, occurs so that the ends of the hose 19 are pushed over a cylindrical projection on respective base parts 24 and 25 of the connectors 20 and 21, with a suitable sealant. Subsequently, and also with the use of a suitable sealant if necessary, respective couplings 26 and 27 are screwed onto the base parts 24 and 25, with the hose 19 being received vacuum-tight between the cylindrical inside wall thereof and the cylindrical projection of the base part 24 or 25. The respective ends of the accordion bellows 18 are soldered vacuum-tight to sleeves 28 and 29. The free end of the sleeve 28 is soldered vacuum-tight to the free end of the coupling part 26, and the free end of the sleeve 29 is soldered vacuum-tight to the coupling 27. The connector 22 is attached to the coupling 27.

Figure 5:
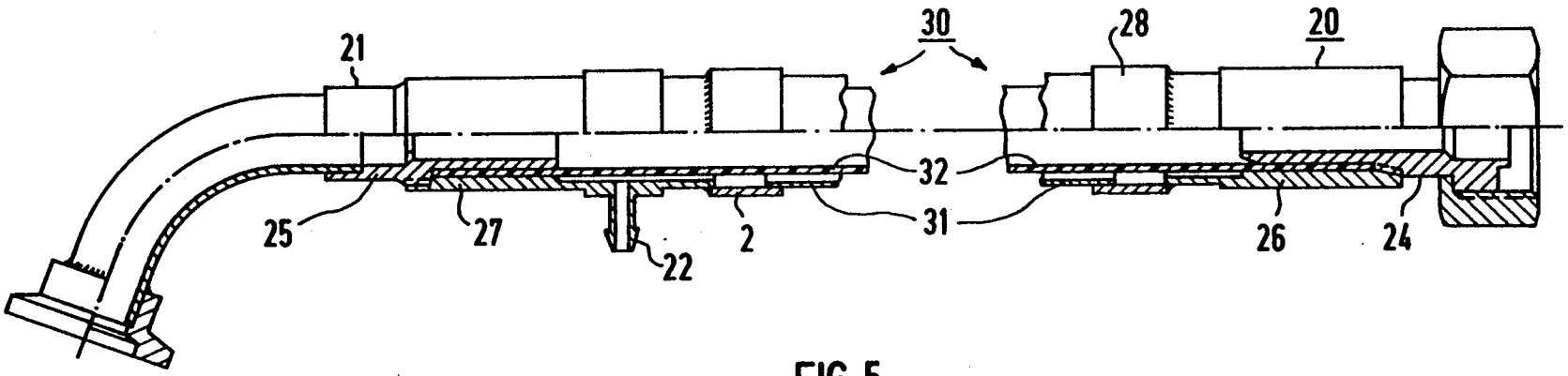
FIG. 5 is a side view of a portion of a double-walled pipe for use in the degasifier in the x-ray radiator in the embodiment of FIG. 2.

When expedient, a double-walled pipe 30 may be used instead of the double-walled hose 17, without having any influence on the above-described functioning of the degasifier. As can be seen in FIG. 5, which illustrates this embodiment, the accordion bellows 18 is replaced by a metallic outside pipe 31, the double-walled pipe 30 again being shown straight in FIG. 5 for simplicity. The polytetrafluorethylene hose 19 is replaced by a polytetrafluorethylene pipe 32, which may be fiber-reinforced. The structure of the connectors 20 and 21 is the same for the double-walled pipe 30 as for the double-walled hose 17.

In the x-ray radiator shown in FIGS. 1 and 2, the protective housing 1 has a partition 33 provided with a resilient membrane 34 which closes the interior volume of the protective housing 1 liquid-tight. The membrane 34 accommodates fluctuations in volume of the insulating oil caused by temperature changes.

The embodiments of the degasifier set forth in FIGS. 2 through 5 are not limited to use in x-ray radiators having a cooling means for the insulating oil. The double-walled hose 17, or the double-walled pipe 30, can be used solely for connecting the interior of the protective housing 1 to the circulating pump 12.

The length of the double-walled hose 17 or the double-walled pipe 30 and the diameter of the polytetrafluorethylene hose 19 or pipe 32 are selected so that the wall area of the hose 19 or the pipe 32 which is effective for degasification is adequate under all operating conditions of the x-ray radiator to degasify the insulating oil to an extent so that no gas bubbles can arise.

It is will be understood it is also possible to use a double-walled pipe or a double-walled hose wherein the liquid to be degasified flows between the outside wall and the inside wall, instead of being contained within the inside wall, and wherein the gas volume is contained within the polytetrafluorethylene inside wall. In such an embodiment, the inside of the polytetrafluorethylene pipe or hose in which the gas volume is situated will be connected to the vacuum pump.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray radiator comprising:

a protective housing filled with liquid;

an x-ray tube disposed in said protective housing; and a degasification means for degasifying said liquid in said protective housing without the formation of gas bubbles in said liquid during the operation of said x-ray tube.

2. An x-ray radiator as claimed in claim 1 further comprising:

means for continuously flowing said liquid through said degasification means.

3. An x-ray radiator as claimed in claim 1 wherein said liquid contains at least one gas therein to be degasified, said gas being at a partial gas pressure in said liquid, and said degasification means comprising:

means for defining a gas volume;

means for defining a space accepting said liquid to be degasified;

a liquid-impermeable wall separating said space from said gas volume; and means for generating a partial gas pressure in said gas volume which is lower than said partial gas pressure of said gas in said liquid in said space.

4. An x-ray radiator as claimed in claim 3 further comprising:

means for continuously flowing said liquid through said space.

5. An x-ray radiator as claimed in claim 3 wherein said liquid contains a plurality of gases to be degasified, including a gas therein at a lowest partial gas pressure in said liquid, and wherein said means for generating a partial gas pressure in said gas volume is a means for generating a partial gas pressure in said gas volume which is lower than said lowest partial gas pressure of said gas in said liquid in said space.

6. An x-ray radiator as claimed in claim 3 wherein said means for generating a partial gas pressure is a means for evacuating said gas volume.

7. An x-ray radiator as claimed in claim 3 wherein said wall consists of polytetrafluorethylene.

8. An x-ray radiator as claimed in claim 3 wherein said wall is formed by a hose.

9. An x-ray radiator as claimed in claim 3 wherein said wall is formed by a pipe.

10. An x-ray radiator as claimed in claim 3 wherein said degasification means includes a double-walled hose having an exterior wall and an interior wall, wherein said gas volume is defined between said exterior wall and said interior wall, and wherein said space is defined in said interior wall.

11. An x-ray radiator as claimed in claim 3 wherein said degasification means includes a double-walled pipe having an exterior wall and an interior wall, wherein said gas volume is defined between said exterior wall and said interior wall, and wherein said space is defined in said interior wall.

12. An x-ray radiator as claimed in claim 1 wherein said degasification means is combined with said protective housing to form a single structural unit.

* * * * *